US011141615B2

(12) United States Patent
Dhyllon

(10) Patent No.: US 11,141,615 B2
(45) Date of Patent: Oct. 12, 2021

(54) IN-GROUND FIRE SUPPRESSION SYSTEM

(71) Applicant: Amen Dhyllon, Wynnewood, PA (US)

(72) Inventor: Amen Dhyllon, Wynnewood, PA (US)

(73) Assignee: Serendipity Technologies LLC, Winnewood, PA (US)

( * ) Notice: Subject to any disclaimer, the term of this patent is extended or adjusted under 35 U.S.C. 154(b) by 69 days.

(21) Appl. No.: 16/387,832

(22) Filed: May 2, 2019

(65) Prior Publication Data

US 2020/0346055 A1 Nov. 5, 2020

(51) Int. Cl.
*A62C 3/02* (2006.01)
*A62C 35/68* (2006.01)

(52) U.S. Cl.
CPC ..... *A62C 3/0278* (2013.01); *A62C 35/68* (2013.01)

(58) Field of Classification Search
CPC ..... A62C 3/0278; A62C 35/68
USPC ..... 169/49, 64, 70, 91
See application file for complete search history.

(56) References Cited

U.S. PATENT DOCUMENTS

| | | | | |
|---|---|---|---|---|
| 1,874,573 | A * | 8/1932 | Moore | A62C 99/009 454/342 |
| 4,601,344 | A | 7/1986 | Reed, Jr. et al. | |
| 5,113,947 | A | 5/1992 | Robin et al. | |
| 5,117,917 | A | 6/1992 | Robin et al. | |
| 5,124,053 | A | 6/1992 | Iikubo et al. | |
| 5,423,384 | A | 6/1995 | Galbraith et al. | |
| 5,465,795 | A | 11/1995 | Galbraith et al. | |
| 5,609,210 | A | 3/1997 | Galbraith et al. | |
| 5,613,562 | A | 3/1997 | Galbraith et al. | |
| 5,756,006 | A | 5/1998 | Reed et al. | |
| 9,144,700 | B2 | 9/2015 | Burkhart et al. | |
| 2019/0290950 | A1 | 9/2019 | Hagge et al. | |

* cited by examiner

*Primary Examiner* — Christopher S Kim
(74) *Attorney, Agent, or Firm* — Adam Warwick Bell; Matthew Rupert Kaser

(57) ABSTRACT

A fire suppression system encompassing a plurality of tubes, buried approximately vertically in the ground, each tube having at least one upper end in open contact with the atmosphere, and a lower end in contact with an underground chamber containing an electron-donating substance, wherein the upper end of the tubes has functionally associated therewith a suction system which sucks air from the local atmosphere into the tubes, and wherein the electron-donating substance reacts with atmospheric oxygen in the air to reduce it and convert it to a form that does not support combustion.

19 Claims, 4 Drawing Sheets

IN-GROUND FIRE SUPPRESSION SYSTEM

RELATIONSHIP TO OTHER APPLICATIONS

None

FIELD OF THE INVENTION

The present invention relates to a device and system for suppressing fire by quickly consuming available oxygen. The system uses an exothermic reaction between oxygen and a solid source of electrons.

BACKGROUND OF THE INVENTION

Fires in built-up areas have become a very serious problem in recent times, for example the 2017 Santa Rosa fire and related fires in Northern California which broke out throughout Napa, Lake, Sonoma, Mendocino, Butte, and Solano Counties during severe fire weather conditions, causing around $14.5 billion in damages. These Northern California fires are predicted to cost the US economy at least $85 billion.

Fire prevention and suppression systems are all very much based in old technology and manpower, and a range of firefighting tactics used to suppress wildfires. Wildfire-trained crews suppress flames, construct fire lines, and extinguish flames and areas of heat to protect resources and natural wilderness. Wildfire suppression also addresses the issues of the wildland-urban interface, where populated areas border with wild land areas.

Fire prevention and suppression systems that do not require large amounts of man-power include compressed air foam systems (CAFS) that discharge a large volume of foam, self-contained wildfire sprinkler systems.

Hypoxic air technology for fire prevention, also known as oxygen reduction system, is an active fire protection technique based on a permanent reduction of the oxygen concentration in the protected rooms. Unlike traditional fire suppression systems that usually extinguish fire after it is detected, hypoxic air is able to prevent fire. However, this cannot be used out of doors.

Another approach is the implementation of the catalytic oxidation of methane as an oxygen removal process, however this is not suitable for fire suppression systems.

Other known technologies for oxygen removal include physical processes, such as adsorption on molecular sieves or activated carbon, membrane separation or certain cryogenic solutions, and chemical processes are suitable to meet the requirements of a residual oxygen content of 10 parts per million by volume. There are two general options. One option is a continuous adsorption based process, commonly using copper or chromium as adsorption materials, or ferrous adsorption materials. The adsorption material is placed in plates, columns, granules etc. For regeneration of the adsorbent, a reducing agent is required. Usually hydrogen is applied. In these traditional systems, the maximum temperature is limited to 250° C. in order to avoid thermal damage of the bed material. As a result of the strong exothermic oxidation reaction, the oxygen amount in the feed gas is limited to 1%/vol. Such processes are typically applied to protect oxygen sensitive systems in the context of fine purification where low oxygen contents are present in the feed gas.

Another commercially available option is a heterogeneously catalyzed oxidation reaction of either hydrogen or hydrocarbons to form water and carbon dioxide as products.

The advantage of hydrogen is that the reaction can be operated at low temperatures (of about 80° C.) when it is catalyzed by noble metals such as platinum or palladium. While methane is the major gas component, many natural gases contain hydrocarbons, like ethane, propane or butane. These hydrocarbons can also be used for catalytic oxygen removal. In case of hydrocarbons higher reaction temperatures as required for hydrogen, typically ranging from 200° C. to 300° C., have to be applied. As long as the oxygen content in the feed is high enough and insulation of the process is adequate, the adiabatic temperature increase of about 10-16 K per 0.1%/vol of oxygen is sufficient to allow for an auto-thermal operation mode. In such a case an electric heating system is only necessary during the start-up period.

Probably the most effective form of prevention is clearing of combustible materials to a considerable distance around homes and other structures.

BRIEF DESCRIPTION OF THE INVENTION

The fire suppression device of the invention encompasses a plurality of tubes with air inlets extending from below ground up to or above the ground level, and also extending downwards into the ground to an underground chamber where atmospheric oxygen is used up or converted to another form that cannot support combustion (we may call this oxygen conversion, or oxygen reduction or oxygen sequestration) or used in combustion or otherwise consumed.

Figure 1:
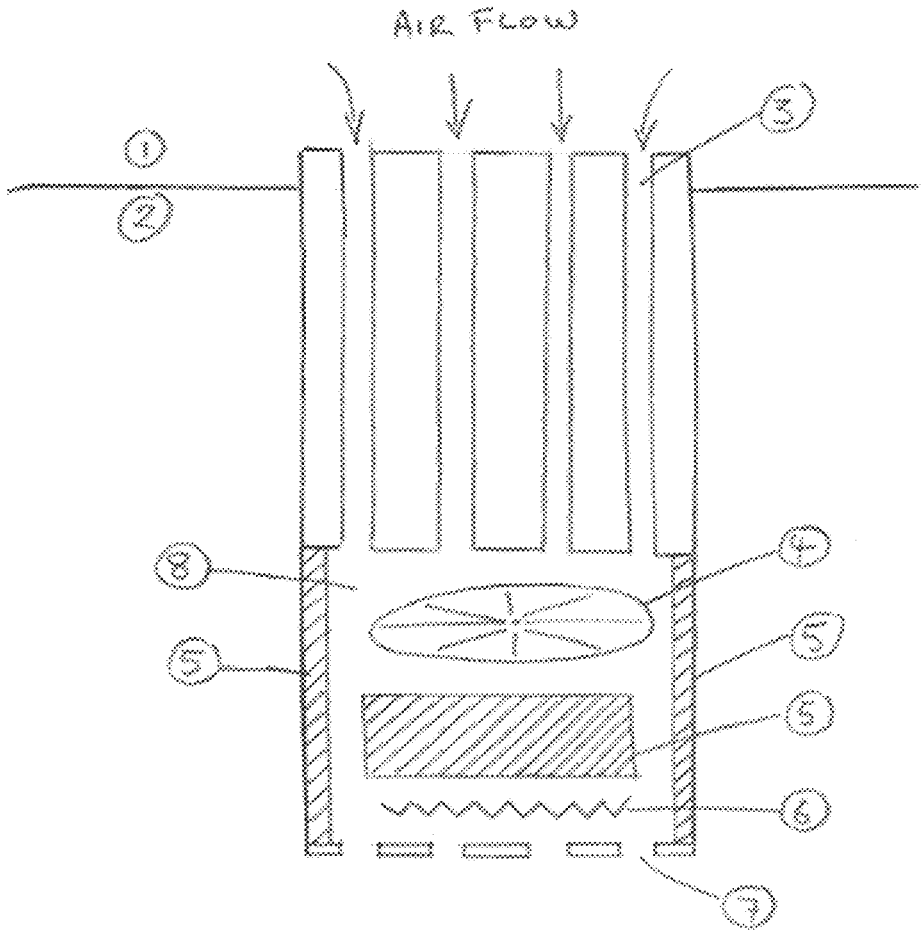
FIG. 1 Shows a schematic representation of the device
Figure 2:
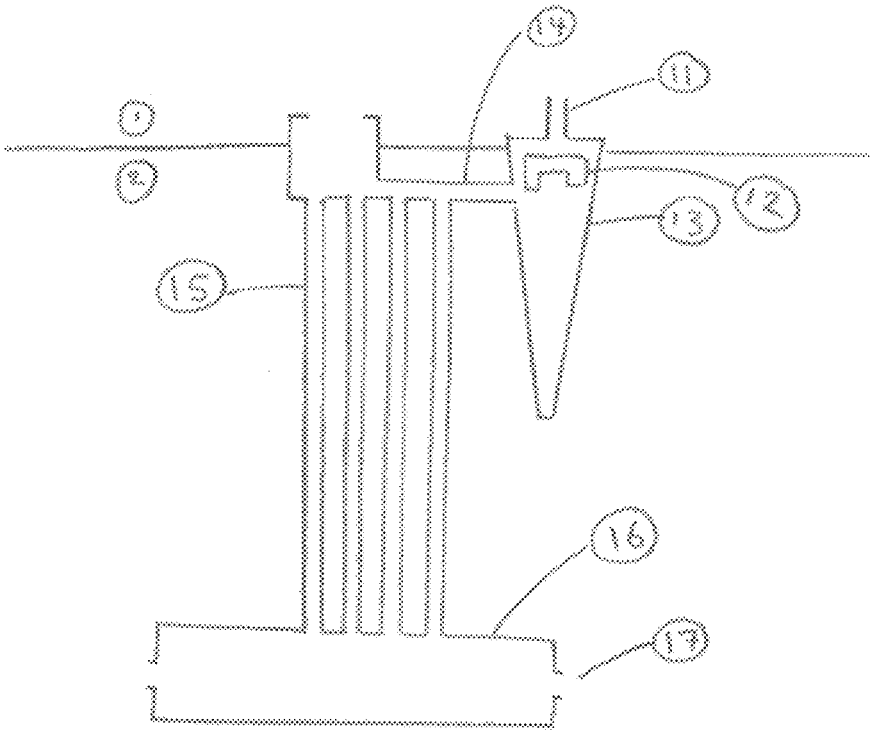
FIG. 2 Shows a representation of the device showing core parts (tubes) and a magnetic device for inducing suction.
Figure 3:
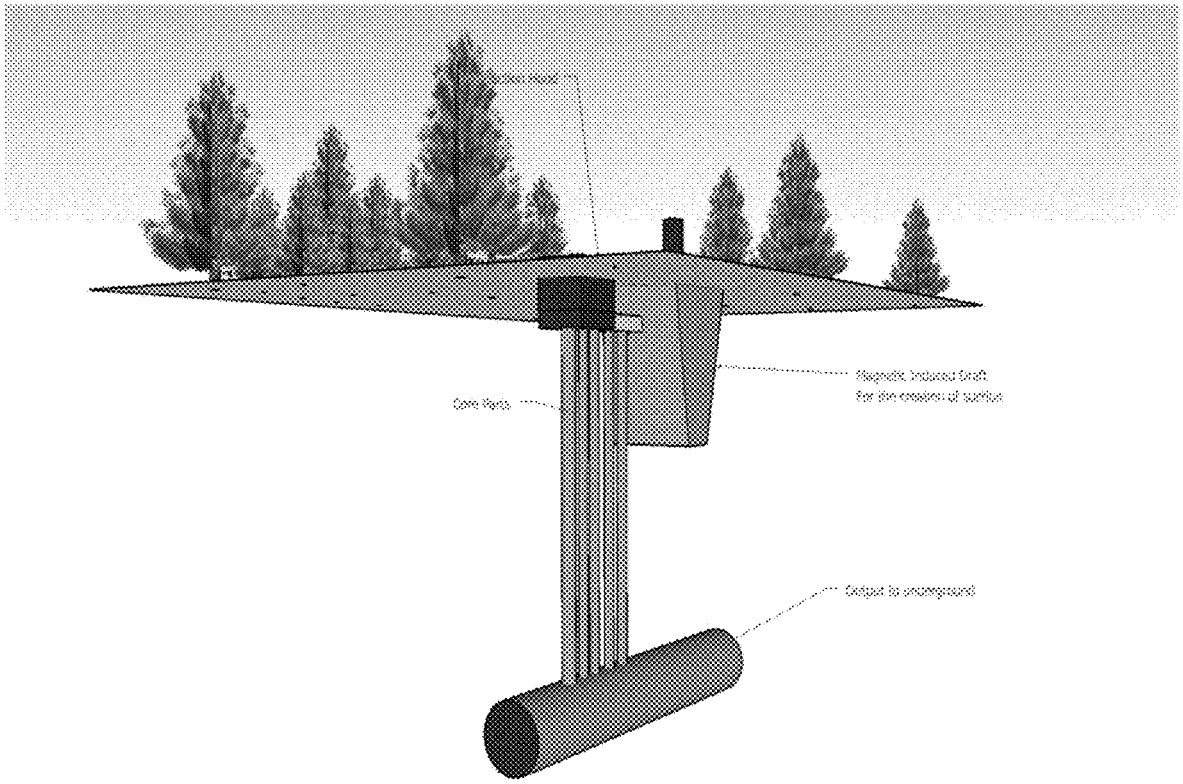
FIG. 3 Shows a representation of the device implanted in the ground showing core parts (tubes) and a magnetic device for inducing suction.
Figure 4:
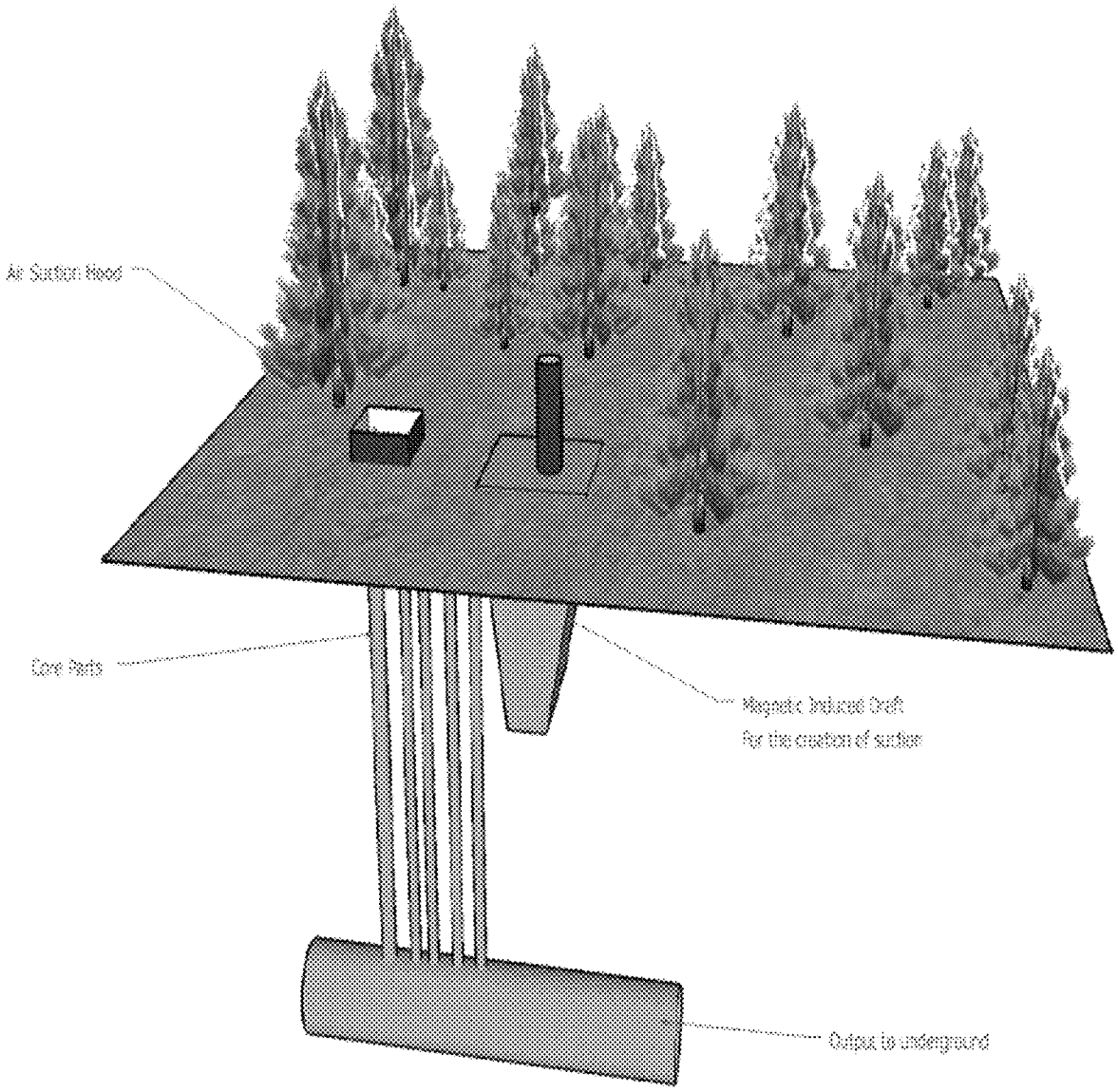
FIG. 4 Shows a representation of the device implanted in the ground showing core parts (tubes) and a magnetic device for inducing suction.

Key: 1=above ground; 2=below ground; 3=air inlet tube; 4=fan; 5=electron donating element; 6=heating element; 7=lower vent holes; 8=chamber in which oxygen reduction occurs or plasma generation may occur to remove oxygen; 9 (reserved); 10 (reserved); 11=air inlet for magnetic suction unit; 12=magnets or magnetic field generator; 13=magnetic induction suction chamber; 14=horizontal air feeder tube; 15=air inlet tube; 16=plasma chamber of chamber in which oxygen reduction occurs to remove oxygen above ground; 17=below ground exhaust vent.

DETAILED DESCRIPTION

The presently disclosed subject matter now will be described more fully hereinafter with reference to the accompanying drawings in which one embodiment is shown. However, it should be understood that this invention may take many different forms and thus should not be construed as being limited to the embodiment set forth herein. All publications mentioned herein are incorporated by reference for all purposes to the extent allowable by law. In addition, in the figures, identical numbers refer to like elements throughout. Additionally, the terms "a" and "an" as used herein do not denote a limitation of quantity, but rather denote the presence of at least one of the referenced items.

Fire cannot burn without oxygen. The present system is designed to rapidly consume all the oxygen from the air within an area (volume), thereby suffocating and extinguishing the fire. The invention sucks oxygen from the local atmosphere and converts it to another form that cannot support combustion.

The device/system is partially buried in the ground and is automatically activated by heat using temperature sensors above or close to the ground.

The device comprises one or a plurality of tubes with air inlets extending to or above the ground level, and the "core tubes" (core parts) extending downwards into the ground to an underground chamber in which the oxygen is used up, and thence, in some embodiments, to an underground outlet, or to an above ground exhaust. In use, the air inlets may be deployed at various different heights to access air from various levels above the ground. Air at different heights may be sucked down sequentially or at different times. Air is sucked down into the tubes and the oxygen is reacted/combusted with a reducing agent at the bottom of the device, and a vacuum will be produced and air will be further sucked into the tubes and down into the reducing chamber creating a self-sustaining suction effect. The reaction may need an initial input of heat, but once the reaction starts, however, it can become self-sustaining because it is exothermic In some embodiments, the surface air inlet tubes are open in a default position, when no fire is present. In others, the surface air inlet tubes are closed in a default position. If closed, they may be fitted with temperature sensitive locks or caps or other closing devices. When the local/immediate temperature sensed by the sensor rises above a certain set amount, such as 75 degrees Centigrade, then the locks or caps, which may be spring loaded, will open to expose the tubes to the air.

An air suction hood above the ground may be provided to suck air into the system. The air suction hood may be provided with one or more fans to draw air into the hood and down into the system.

The air suction hood may be provided with magnets to induce a magnetic-induced draft for the creation of suction, which may be connected to the air suction hood, and/or to the core tubes. The invention may use a magnetic field or a high frequency voltage to ionize the oxygen molecules, and to concentrate and channel the ionized oxygen from the atmosphere into a combustion chamber. In some embodiments, the magnetic field produced paramagnetic oxygen which can be concentrated by the magnetic field and fed into the core tubes.

The suction fan may also be activated using a temperature sensitive switch. A typical temperature sensitive switch will employ a thermocouple.

In one embodiment, a plurality of tubes extends above the surface of the ground, and into an underground chamber, containing a fan to produce suction, sucking the air into a further and deeper underground chamber, where oxygen is combined with an agent to reduce it and remove its ability to sustain combustion of a fuel.

In some embodiments, the fan may be placed about half way down in the device, at the bottom of the plurality of tubes, but above the underground chamber containing an electron-donating substance.

At the bottom of the system, buried in the ground, is an apparatus which removes oxygen by burning and/or combining the oxygen the with one or more reducing substances. The resulting product is either a solid or a liquid product, which either does not requiring venting, because the volume is so small, or may be released into the surrounding soil. The resulting product may be a combustion product which may be vented to the atmosphere, but which does not include a significant oxygen concentration, and will not support significant combustion.

When the oxygen is reacted/combusted/reduced with the combustion agent/fuel/reducing agent at the bottom of the device, a vacuum will be produced and air will be sucked into the tubes and down into the reducing chamber.

In one embodiment, the system includes underground, heated reducing agents, such as metal or carbon elements. Carbon elements may be nanocarbon elements, which heat up and burn the oxygen by reaction by contacting the oxygen with a source of electrons. The oxidized species loses electrons, while the reduced (oxygen) species gains electrons. The oxidized species may be a solid, or metal or a metal alloy, or a carbon material such as carbon fiber or a nanocarbon material, such as carbon nanotubes.

In one embodiment, the system includes, underground, adsorption materials or heated reducing agents, such as metals, for example copper or chromium or aluminum or iron as adsorption materials. Copper oxide is formed when copper reacts with oxygen and chromium oxide is formed when chromium reacts with oxygen. This reaction can be started by heating copper or other metal with a burner, turning the original copper black. Once the reaction starts, however, it can become self-sustaining because it is exothermic.

In some embodiments, the metals can be provided as a bed of granules to maximize surface area and therefore efficiency of Oxygen removal. In some embodiments, the metal is in the form of rods, dust, plates, granules, nuggets ingots, etc.

In some embodiments, the metal is kept away from air in a sealed container or underground silo until it is required. This prevents oxidation before activation of the system is required.

In one embodiment, the system includes, underground, a device and system for energy generation comprising a thermoelectric generator (TEG), and a low-power solid-state heating element, for example an electrically-conductive element that heats up as electric current passes through it, such as a low-power heated graphite element or any carbon-based conductor substance such as, particularly, graphene or carbon nanotubes or carbon nano-materials of any formulation or construction.

In some embodiments, the surface air inlet tubes are open. In others, the surface air inlet tubes are closed. If closed, they may be fitted with temperature sensitive locks or caps or other closing devices. When the temperature of the sensor rises above a certain set amount, such as 75 (or 80 or 90 or 95) degrees Centigrade, then the locks open and the caps, which may be spring loaded or may simply melt or disintegrate or break upon exposure to a minimum heat, open to expose the tubes to the air.

Thermal Initiators

When the system is activated, the oxygen conversion agent (reducing agent) (metal) is heated up to start the reaction, which then becomes exothermic and self-sustaining. Heating can be done electrically by using a network of electrical heating filaments running through the bed of granules. Or it can be done by a thermal reaction such as the burning of a chemical fuel or a heat initiator such as a combustible substance.

In one embodiment, the thermal initiator is a spontaneously igniting substance such as a highly reactive metal or phosphorous. Phosphorous (such as white phosphorous) or aluminum may be used because it burns rapidly and very hot. Also, Group I metals (alkali metals) such as lithium, sodium, potassium, rubidium, cesium and francium burns upon contact with damp air or water vapor. If any of these heat initiators are employed, them must be kept out of contact with any oxygen until needed.

The thermal initiators of course must not be activated until needed, or they will burn up all the fuel as well as themselves. Most of the thermal initiators used will be highly combustible and some may even combust spontaneously on contact with air or moisture. They may be kept away from oxygen and atmospheric oxygen until needed. They may be retained in a sealed compartment, which is opened only upon activation by a sensor sensing heat above ground. The sealed compartment may be kept closed in a default state, and may be fitted with temperature sensitive locks or caps or other closing devices. When the temperature of the sensed temperature rises above a certain set amount, such as 75 (or 80 or 90 or 95) degrees Centigrade, then the locks open and the caps, which may be spring loaded, or which may simply melt or decompose with heat, to open and expose the thermal initiators to the air.

Temperature sensors may be of a simple type commonly used in fire sprinkler systems. See US app. No. U.S. Pat. Nos. 6,024,174, 3,734,191; U.S. Pat. No. Re. 29,155; U.S. Pat. Nos. 4,899,825; 5,183,116; and 5,441,113, all incorporated by reference. Temperature sensors may also include Negative Temperature Coefficient (NTC) thermistors, Resistance Temperature Detectors, Thermocouples, and Semiconductor-based sensors. The sensor may also be an optical sensor such as an infrared sensor.

Oxygen Reducing and Electron-Donating Elements

In some embodiments, heated iron granules are used to absorb oxygen. Oxidation of iron at temperatures above 700° C. follows the parabolic law with the development of a three-layered hematite/magnetite/wüstite scale structure. However, at temperatures below 700° C., inconsistent results have been reported, and the scale structures are less regular, significantly affected by sample-preparation methods. Oxidation of carbon steel is generally slower than iron oxidation. For very short-time oxidation, the scale structures are similar to those formed on iron, but for longer-time oxidation, because of the less adherent nature, the scale structures developed are typically much more complex. Continuous-cooling conditions, after very short-time oxidation, favor the retention of an adherent scale, suggesting that the method proposed by Kofstad for deriving the rate constant using continuous cooling or heating-oxidation data is more appropriate for steel oxidation. Oxygen availability has certain effects on iron and steel oxidation. Under continuous cooling conditions, the final scale structure is found to be a function of the starting temperature for cooling and the cooling rate. Different scale structures develop across the width of a hot-rolled strip because of the varied oxygen availability and cooling rates at different locations.

The oxygen adsorption/reduction materials or other heated reducing agents may be metals, for example copper or chromium or aluminum or iron as adsorption materials. Copper oxide is formed when copper reacts with oxygen and chromium oxide is formed when chromium reacts with oxygen. The reaction can be initiated by heating copper or other metal with a burner combusting substance, electrical heating etc., and when a certain heat is reached, the reaction can then become self-sustaining because it is exothermic.

In some embodiments, the metals can be provided as a bed of granules to maximize surface area and therefore efficiency of Oxygen removal. In some embodiments, the metal is in the form of rods, dust, plates, granules, nuggets ingots, etc.

In this disclosure, we will sometimes refer to the reducing element as a graphite element, but in various embodiments the heating element may be in the form of another form of carbon or may be another heating element such as a metal element or other electrically conductive substance. The present invention does not employ an exogenous fuel source, but uses a reducing agent to remove the Oxygen. When used, graphite can obtain very high temperatures without melting or burning.

Plasma

In one embodiment, the system includes a source of plasma. Oxygen is consumed by creating a plasma. In some embodiments, plasma is generated by subjecting oxygen (O2) to a strong electromagnetic field. The oxygen plasma enters a chamber and is combined with free electrons from a solid electron-donation element thereby producing heat. Plasma is an ionized state of matter. Plasma can be artificially generated by heating or subjecting a neutral gas to a strong electromagnetic field. The ionized gaseous substance becomes electrically conductive. Positive charges in ions are achieved by stripping away electrons orbiting the atomic nuclei, where the total number of electrons removed is related to either increasing temperature or the local density of other ionized matter. When the ionized gas molecules recombine with electrons, they produce an exothermic reaction.

U.S. patent application Ser. Nos. 16/132,590 and 16/131,375, both by the same inventor of the instant application, disclose systems and methods for generating energy using plasmas and electron-donation elements to produce heat. Both applications are incorporated by reference for all purposes.

U.S. Ser. No. 16/132,590 discloses, amongst other things, a device for generating electrical energy comprising: a thermoelectric generator (TEG) element having a first surface and a second surface, a solid-state heating element comprising a carbon compound, in contact with the first surface, and a cooling means in contact with the second surface, a means for heating the solid-state heating element in functional contact with the solid-state heating element, and a means, connected to the thermal electric generator (TEG) element, for conducting away electrical energy generated by the thermal electric generator element. The device may use a solid-state heating element composed of a compound that is at least 90% carbon, and the solid-state heating element may graphite or graphite or carbon nanotubes.

U.S. Ser. No. 16/131,375 discloses a device for generating heat energy comprising: a plasma chamber composed of a substantially closed container having an outer surface and an inner surface, defined by walls, and enclosing an interior space, the interior space enclosing at least one electron-donation element, further comprising one or more gas inlets traversing the walls and adapted to introduce gas from outside the plasma chamber into the interior space of the plasma chamber, further comprising one or more magnetic field generators positioned in proximity to one or more of the gas inlets, further comprising a flu gas outlet. The device of the electron-donation element may be titanium and/or platinum. The walls may have layers, comprising, from the inside towards the outside, a heat-conducting layer, a thermo-electric voltage-generator layer, a coolant-conducting layer, and an insulating later. The heat conducting layer may consist of metal coils which may be of brass and are at least partially coated with zirconia.

The invention, in one embodiment, encompasses a device for removing Oxygen species from the air using a plasma. One embodiment employs a plasma furnace to consume oxygen and to contain and produce an exothermic reaction wherein, by application of a magnetic or electromagnetic filed, an oxygen plasma (an electronegative plasma) or oxygen atoms and/or ions or reactive oxygen species are combined with electrons from an electron source (a reducing substance that donates electrons). Oxygen plasma or oxygen atoms or reactive oxygen species and/or ions are combined with electrons that have been 'driven off' from a more electropositive component of the plasma chamber (an "electron-donation element") to produce an exothermic reaction. When the reaction reaches a certain temperature, it becomes self-sustaining and the exothermicity constantly increases the temperature in the plasma chamber unless heat is removed by cooling. Cooling occurs as part of energy generation. In an alternative embodiment oxygen atoms and/or ions are combined with a fuel which is positively charged due to the effects of heating.

The exothermic reaction may in one embodiment be carried out by reacting Oxygen plasma with a reducing agent or a fuel to produce pyrolytic combustion (oxidation). Such fuel may be a solid fuel (any combustible solid including municipal waste). In another embodiment, the fuel may be a gas fuel such as natural gas, hydrogen, methane etc. In a further embodiment, the fuel may be a liquid fuel such as a petroleum or other hydrocarbon liquid fuel or in some embodiments, water.

In another embodiment, the exothermic reaction uses no 'fuel' at all, i.e., no exogenous fuel is added to the plasma chamber, but the electronegative oxygen plasma reacts rapidly with electrons liberated from interior reducing agent components ("electron-donation elements") of the plasma chamber itself to provide a self-sustaining exothermic reaction.

Any substance capable of providing electrons for reaction with the Oxygen plasma species or oxygen atoms and/or ions may be used as an electron-donation (reducing) element. In preferred embodiments, the electron-donation element is a metal, for example titanium and/or platinum or related metals. The titanium and/or platinum may be provided as blocks, plates, filaments or any other appropriate shaped form, and will act as a continuous long term source of electrons for as long as they last, which is dependent on their mass and shape, and may be from days, to weeks to months or even years. The electrons from the titanium and/or platinum electron-donation elements will combine with the other reactive species derived from atmospheric Oxygen ($O_2$). Atmospheric Oxygen is passed through a magnetic or electromagnetic field producing oxygen atoms and/or ions. In some embodiments, they will form stable molecules of $O^{-2}$, $O_2$ with a single negative charge or single atoms of atomic oxygen with two negative charges or superoxide ($O^{2-}$) or peroxide ($O_2^{2-}$) ions. Formation of $O^{-2}$ is an exothermic reaction. This entire process forms hot ionized oxygen plasma. Other possibilities are that two ozone molecules can form from three dioxygen molecules. When combined with free electrons, anion-radical O2*- may be formed and heat generated.

In various embodiments, oxygen atoms, not oxygen molecules, enter the chamber. The electro-magnetic field sucks in ambient oxygen, converts it to oxygen atoms and funnels these into the chamber. The titanium and/or platinum filaments give off electrons and that these electrons react with atmospheric Oxygen ($O_2$) to form a stable molecule $O^{-2}$. Formation of $O^{-2}$ is an exothermic reaction. $O^{-2}$ is hot ionized gas.

In one specific embodiment, the interior of the plasma chamber contains an electron-donation (reducing) element and the interior walls comprise brass coils that are part of the inner wall of the plasma chamber. Brass is used because of its high thermal conductivity, thereby conducting heat efficiently from the inner void to the adjacent layer, for example to a thermo-electric-voltage-generator layer. The inner side (the inner surface facing the void) of these brass coils may be covered with zirconium to efficiently contain the heat inside the chamber, thereby minimizing heat loss. Electron-donation elements are provided by titanium and/or platinum in the form of blocks, plates, filaments or any other appropriate shaped form and provide a continuous long term source of electrons. In some embodiments, these electrons will combine with the incoming oxygen atoms from the ambient air to form stable molecules of $O^{-2}$. Formation of $O^{-2}$ is an exothermic reaction. This entire process forms hot ionized oxygen plasma. An initial plasma state is created and then expands by adding more and more $O^{-2}$ molecules.

When the plasma chamber reaches a certain temperature, no exogenous source of heat is required to drive off electrons from the electron-donation elements, therefore the exothermic reaction becomes self-sustaining until the electron-donation elements are exhausted (which should be days, weeks or months depending on design).

The invention may use a magnetic field or a high frequency voltage to ionize the oxygen molecules, and to concentrate and channel the ionized oxygen from the atmosphere into a combustion chamber, wherein the oxygen ions, which are negatively charged, react either with fuel or electrons provided by electron-donation elements.

In a specific embodiment, the invention provides a device with walls having several layers, with, from the inside towards the outside, a heat-conducting layer, a thermo-electric-voltage-generator layer, a coolant-conducting layer, and an insulating later.

In various embodiments, the heat-conducting layer comprises a metal, which may be metal tubing, for example brass tubing, such as coiled brass tubing. The metal tubing may be at least partially coated with a ceramic material. The ceramic material may comprise zirconia (ZrO2). The thermo-electric-voltage-generator layer may comprise a thermocouple or thermopile.

Embodiments and Further Detailed Description of the Invention

In a specific, preferred embodiment, the fire suppression device encompasses a plurality of tubes with air inlets extending to or above the ground level, and also extending downwards into the ground to an underground chamber where atmospheric oxygen is reduced, converted to another molecule or otherwise consumed. Oxygen consumption is achieved by means of a reducing chamber which encompasses the following: A device for removing oxygen from ambient air comprising a plasma chamber comprising a substantially closed container defined by walls having an outer surface and an inner surface and enclosing an interior space, the interior space enclosing an electron-donation element such as a metal, such as copper, wherein the device comprises one or more gas inlets adapted to introduce gas into the plasma chamber; one or more magnetic field generators positioned in proximity to one or more of the gas inlets; one or more flu gas outlets attached to the plasma chamber adapted to facilitate the exit of gasses from the plasma chamber; wherein said walls have several layers, comprising, from the inside towards the outside, a brass coil layer wherein the brass coils are at least partially coated by zirconia or other ceramic materials.

Other representative embodiments of the invention include a device for suppressing fire by removing oxygen from the local atmosphere, the device comprising one or a plurality of tubes, buried approximately vertically in the ground, each tube having at least one upper end in open contact with the atmosphere, and a lower end in contact with an underground chamber containing an electron-donating substance, wherein the upper end of the tubes has functionally associated therewith a suction system which sucks air from the local atmosphere into the tubes, and wherein the electron-donating substance reacts with atmospheric oxygen in the air to reduce it and convert it to a form that does not support combustion, effectively removing oxygen from the local atmosphere.

The electron-donating substance may comprise a plasma, a carbon compound, a metal, copper, or iron. It can be the form of a bed of granules. The suction system can comprise a magnetic field that attracts paramagnetic oxygen molecules or a fan. The device may include a heating means for initial heating of the electron-donating substance such as an electrical heating element, a combustible substance, a spontaneously igniting substance, a Group I alkali metal, for example phosphorous. The heating means heats up the electron-donating substance to initiate the reaction, which then becomes exothermic and self-sustaining.

The underground chamber, in some embodiments, has no flue gas external vent. But in other embodiments it can.

The upper end of said tubes may be closed when not in use and automatically openable by means of thermally sensitive locks.

The plurality of tubes can be exposed at their upper ends to the atmosphere at different heights above the ground.

The invention further encompasses method for suppressing fire by removing oxygen from the local atmosphere, the method comprising providing a device comprising one or a plurality of tubes, buried approximately vertically in the ground, each tube having at least one upper end in open contact with the atmosphere, and a lower end in contact with an underground chamber containing an electron-donating substance, wherein the upper end of the tubes has functionally associated therewith a suction system which sucks air from the local atmosphere into the tubes, and wherein the electron-donating substance reacts with atmospheric oxygen in the air to reduce it and convert it to a form that does not support combustion: wherein the electron-donating substance comprises a plasma: and wherein the device includes a heating means for initial heating of the electron-donating substance: and wherein the heating means heats up the electron-donating substance to initiate the reaction, which then becomes exothermic and self-sustaining.

Methods of the Invention

Another aspect of the invention encompasses methods for removing oxygen from ambient air comprising providing a device comprising a plurality of tubes with air inlets extending to or above the ground level, and also extending downwards into the ground to an underground chamber where atmospheric oxygen is reduced, converted to another molecule or otherwise consumed. Oxygen consumption is achieved by means of a reducing chamber as described herein.

Definitions and Further Information Relevant to Embodiments

The phrase "the local atmosphere" refers to the air in the immediate surrounding area, for example within a radius of 800 feet, or alternatively 500, 400, 300, 200 100 or 50 feet from the tubes of the device above the ground.

Reduction: a chemical reaction that involves the gaining of electrons by one of the atoms involved in the reaction between two elements. The term refers to the element that accepts electrons, as the oxidation state of the element that gains electrons is lowered.

Reducing agent: any material comprising an electron-donating substance.

Paramagnetism: a form of magnetism whereby certain materials are weakly attracted by an externally applied magnetic field, and form internal, induced magnetic fields in the direction of the applied magnetic field. In contrast with this behavior, diamagnetic materials are repelled by magnetic fields and form induced magnetic fields in the direction opposite to that of the applied magnetic field.

Paramagnetic oxygen: Oxygen is paramagnetic. It is attracted by the magnetic field but does not remain magnetic once it leaves the field. Gaseous oxygen is paramagnetic because the oxygen molecule has two unpaired electrons. Oxygen is attracted toward the magnetic field while Nitrogen is repelled.

Plasma chamber=a chamber adapted to contain a plasma or other reactive oxygen species, and in which heat is generated by the reaction of a plasma or other reactive oxygen species with electrons.

Electron-donation element=any substance capable of providing electrons for reaction with the oxygen plasma species may be used as an electron-donation element. In preferred embodiments, the electron-donation element is a metal, for example titanium and/or platinum or related metals.

Plasma=a plasma is one of the four fundamental states of matter. It does not exist freely on the Earth's surface under normal conditions. Plasma can be artificially generated by heating or subjecting a neutral gas to a strong electromagnetic field creating an ionized gaseous state that is electrically conductive. Plasmas can also be created by using high frequency voltages (typically kHz to >MHz) to ionize gas (usually at low pressure). Either system may be used in the present invention. At this point, electromagnetic fields dominate the behavior of the matter. Based on the surrounding environmental temperature and density, partially ionized or fully ionized forms of plasma may be produced. Neon signs and lightning are examples of partially ionized plasma, while the interior of the stars contains fully ionized plasma. Plasma is an electrically neutral medium of unbound positive and negative particles (i.e. the overall charge of a plasma is roughly zero). Although these particles are unbound, they are not 'free' in the sense of not experiencing forces. In U.S. Pat. No. 0,514,170 ("Incandescent Electric Light", 1894 Feb. 6), Nikola Tesla describes a plasma lamp. In plasma, gas atoms are excited to higher energy states and are ionized. As the electrons fall back to their valence states and into their normal energetic states in the electron shells, they release a photon of light, this results in the characteristic "glow" or light associated with plasma. Oxygen plasma emits a light blue color. A plasma's activated species include atoms, molecules, ions, electrons, free radicals, metastable compounds, and photons in the short wave ultraviolet (vacuum UV, or VUV for short) range. This mixture can exist at around room temperature, and provides a highly reactive gas that interacts with almost any surface in contact with the plasma. If the gas used is oxygen, the plasma highly reactive and the VUV energy is very effective in the breaking of most organic bonds (i.e., C—H, C≡C, C=C, C—O, and C≡N) as well as any high molecular weight contaminants. The oxygen species created in the plasma ($O^{2+}$, $O^{2-}$, $O_3$, O, $O^+$, $O^-$, ionized ozone, metastable excited oxygen, and free electrons) react with most substrates including organic contaminants to form $H_2O$, CO, $CO_2$, and lower molecular weight hydrocarbons. These compounds have relatively high vapor pressures and are evacuated easily.

a heat-conducting (layer)=a layer in the wall of a plasma chamber adapted to absorb, and/or conduct and/or retain heat, and in some cases to provide a source of electrons that may combine with negatively charged plasma particles in the plasma chamber in an exothermic reaction.

a thermo-electric-voltage-generator (layer)=a layer in the wall of a plasma chamber adapted to produce electricity from heat or from a heat differential, such as a thermocouple, which is an electrical device consisting of two dissimilar electrical conductors that produces a temperature-dependent voltage as a result of the thermoelectric effect.

Walls=the device includes walls, that in some embodiments have several layers, comprising, from the inside towards the outside, for example, and not exclusively, a brass coil layer wherein the brass coils are coated by zirconia or other ceramic materials, a thermo-electric-voltage-generator layer, a coolant-conducting layer, and an insulating later. It should be noted that the components of the layers need not be present over the entire surface of the walls, but may be present only on certain walls or at certain portions of the walls.

Zirconia: Zirconium dioxide is a ceramic material used in various applications such as dentistry and jet engine manufacture. ZrO2 adopts a monoclinic crystal structure at room temperature and transitions to tetragonal and cubic at higher temperatures. The change of volume caused by the structure transitions from tetragonal to monoclinic to cubic induces large stresses, causing it to crack upon cooling from high temperatures. When the zirconia is blended with some other oxides, the tetragonal and/or cubic phases are stabilized. Effective dopants include magnesium oxide (MgO), yttrium oxide ($Y_2O_3$, yttria), calcium oxide (CaO), and cerium(III) oxide (Ce2O3). The very low thermal conductivity of cubic phase of zirconia also has led to its use as a thermal barrier coating, or TBC, in jet and diesel engines to allow operation at higher temperatures. Thermodynamically, the higher the operation temperature of an engine, the greater the possible efficiency. Another low thermal conductivity use is a ceramic fiber insulation for crystal growth furnaces, fuel cell stack insulation and infrared heating systems.

The claims, disclosure and drawings of the present invention define but are not intended to limit the invention.

All patents and publications disclosed herein are incorporated by reference to the fullest extent permissible by law.

REFERENCES

[1] Biogasanlagen zur Biomethanproduktion in Deutschl. FNR Mediathek, 2014.

[2] Köppel, W; Graf, F.: gwf-Gas Erdgas International 151 (2010) 13, 38-46.

[3] Köppel et al.: Abschlussbericht G 1 03 10: Monitoring Biogas II. (09/2013).

[4] Muschalle, T.; Amro, M. DGMK research report, Vol. 753, Hamburg 2013.

[5] Wagner, M. et al.: DGMK Research Report 756; Literature Study (2013).

[6] Groneman, U. et al.: gwf-GaslErdgas International 151 (2010) 13, 26-32.

[7] DVGW-Arbeitsblatt G 260: Gasbeschaffenheit. January 2012.

[8] EASEE-Gas: CBP 2005-001/02; Harmonization of Natural Gas Quality.

[9] Köppel, W. et al.: gwf-GaslErdgas 153 (2012) 1, 2-11.

[10] Graf, F.; Bajohr, S.: Biogas—Erzeugung, Aufbereitung, Einspeisung. 2. Edition, Munchen: Oldenbourg Industrieverlag (2014).

[11] Pernicone, N. et al.: Applied Catalysis A: General 240 (2003), 199-206.

[12] Silica V T, Berlin: www.silica.berlin/pdf/processgas-_end_deutsch_web.pdf

[13] Newpoint Gas, L P: Oxygen Removal from Natural Gas: Newpoint Gas O2 Removal Services. http://www.newpointgas.com/naturalgas_oxygen.php

[14] Knebel, F. W.: Erdgasvorwärmung durch direkte katalytische Oxidation; Dissertation, Universität Karlsruhe (TH), 2000.

[15] Frankovsky, R.; Ortloff, F.: Katalytische Entfernung von Sauerstoff aus Biogas mittels Oxidation von Methan. Diplomarbeit, KIT (2013)

[16] Reinke, M.; Katalytisch stabilisierte Verbrennung von CH4/Luft-Gemischen und H2O- und CO2- verthünnten CH4/Luft-Gemischen über Platin unter Hochdruckbedingungen; Dissertation, ETH Zurich (2005)

[17] BNetzA: Biogasmonitoringbericht 2013.

[18] U.S. patent application Ser. Nos. 16/132,590 and 16/131,375 to Amen Dhyllon

The invention claimed is:

1. A device for suppressing fire by removing oxygen from a local atmosphere, the device comprising one or a plurality of tubes, buried approximately vertically in the ground, each tube having an upper end in open contact with the atmosphere and a lower end in contact with an underground chamber, wherein the underground chamber contains an electron-donating substance, wherein the upper end of at least one of said one or a plurality of tubes has functionally associated therewith a suction system which sucks air from the local atmosphere into the underground chamber, and wherein the electron-donating substance reacts with atmospheric oxygen in the air to reduce it and convert it to a form that does not support combustion, effectively removing oxygen from the local atmosphere.

2. The device of claim 1 wherein the electron-donating substance comprises a plasma.

3. The device of claim 1 wherein the electron-donating substance comprises a metal.

4. The device of claim 3 wherein the electron-donating substance comprises copper.

5. The device of claim 3 wherein the electron-donating substance comprises iron.

6. The device of claim 3 wherein the electron-donating substance comprises a bed of granules.

7. The device of claim 1 wherein the suction system comprises a magnetic field that attracts paramagnetic oxygen molecules.

8. The device of claim 1 wherein the suction system comprises a fan.

9. The device of claim 1 wherein the device includes a heating means for initial heating of the electron-donating substance.

10. The device of claim 9 wherein the heating means comprises an electrical heating element.

11. The device of claim 9 wherein the heating means comprises a combustible substance.

12. The device of claim 11 wherein the combustible substance is a spontaneously igniting substance.

13. The device of claim 12 wherein the combustible substance comprises a Group I alkali metal.

14. The device of claim 12 wherein the combustible substance comprises phosphorous.

15. The device of claim 9 wherein the heating means heats up the electron-donating substance to initiate the reaction, which then becomes exothermic and self-sustaining.

16. The device of claim 1 wherein the underground chamber has no flue gas external vent.

17. The device of claim 1 wherein the upper end of said tubes is closable and automatically openable by means of thermally sensitive locks.

18. The device of claim 1 wherein the plurality of tubes is exposed at their upper ends to the atmosphere at different heights above the ground.

19. The device of claim 1 wherein the electron-donating substance comprises a carbon compound.

* * * * *